US011850199B2

(12) United States Patent
Kettner et al.

(10) Patent No.: US 11,850,199 B2
(45) Date of Patent: Dec. 26, 2023

(54) MEDICAL TRACTION SYSTEM WITH LOW BACK-TRAVEL

(71) Applicant: Match Grade Medical LLC, Neenah, WI (US)

(72) Inventors: David M. Kettner, Greenville, WI (US); Leslie John Wendrick, Neenah, WI (US)

(73) Assignee: Match Grade Medical LLC, Neenah, WI (US)

( * ) Notice: Subject to any disclaimer, the term of this patent is extended or adjusted under 35 U.S.C. 154(b) by 228 days.

(21) Appl. No.: 17/222,257

(22) Filed: Apr. 5, 2021

(65) Prior Publication Data

US 2022/0313530 A1 Oct. 6, 2022

(51) Int. Cl.
*A61H 1/02* (2006.01)

(52) U.S. Cl.
CPC ... *A61H 1/0222* (2013.01); *A61H 2201/1418* (2013.01); *A61H 2201/164* (2013.01)

(58) Field of Classification Search
CPC ..... A61H 1/0218–0229; A61H 1/0237; A61H 2201/1418; A61H 2201/164; A61F 5/04; A61F 5/048; A61G 13/0036; A61G 13/10; A61G 13/12; A61G 13/1245; A61G 13/129; A61G 13/1295; A61B 17/025; A61B 90/50; A61B 17/66; A61B 17/6408
See application file for complete search history.

(56) References Cited

U.S. PATENT DOCUMENTS 5,020,525 A * 6/1991 Ewing ..... A61G 13/0036 606/241
5,860,493 A * 1/1999 Cherpitel ..... A62B 1/14 188/65.1
RE46,032 E * 6/2016 Torrie ..... A61H 1/0218
2016/0095785 A1* 4/2016 Catacchio ..... A61H 1/0218 602/36

OTHER PUBLICATIONS

Vaino Kodas, Engineering Principles Used in the Design of Camming Devices for Rock Climbing, 2020, p. 3. Archived by Wayback Machine on Dec. 30, 2022. (Year: 2022).*

* cited by examiner

*Primary Examiner* — Victoria Murphy
*Assistant Examiner* — Allison S. Lown
(74) *Attorney, Agent, or Firm* — Boyle Fredrickson, S.C.

(57) ABSTRACT

A medical traction system provides an elongate track having a slide with a handle so that tensioning of the strap can be performed directly on the slide with improved tension sensitivity. The slide provides a cam mechanism with low back-travel automatically locking the slide when tension is released permitting one-handed operation.

15 Claims, 5 Drawing Sheets

MEDICAL TRACTION SYSTEM WITH LOW BACK-TRAVEL

STATEMENT REGARDING FEDERALLY SPONSORED RESEARCH OR DEVELOPMENT

--

CROSS REFERENCE TO RELATED APPLICATION

--

BACKGROUND OF THE INVENTION

The present invention relates to medical distraction/traction devices for surgical procedures and in particular to a rapidly adjustable, intuitive traction device having low back-travel.

During surgery it may be necessary to apply a traction force to a limb such as the leg or arm. For this purpose, a flexible traction strap may be attached between the end of the limb, for example, the ankle or wrist, and a traction mechanism extending from a patient table or the like.

A commonly used traction mechanism uses cables and weights to apply a traction force that is well defined by the weights. All such traction mechanisms may be useful during rehabilitation but they can be inconvenient in the surgical suite, blocking access to the patient and being difficult to sterilize, set up, and adjust.

Simpler traction mechanisms have been developed, for example, using a simple turnbuckle inserted along the length of the traction strap to change the length of the strap. Such turnbuckle mechanisms, however, while simple, can impart undesired twisting to the traction strap, are slow to adjust, and have a limited adjustment range. They also can make it difficult to assess the amount of traction force being applied because of the high mechanical advantage between the turnbuckle screw action and the force applied to the turnbuckle.

A simple slide and locking knob can be used, where the strap is grasped to directly tension the strap while the slide is adjusted to remove any slack and the knob tightened, often by a second individual. By grasping the strap directly, a good intuitive sense of tension can be quickly obtained but there can be an undesirable relaxation in the traction force caused by slight elasticity in the strap between the point of tensioning and the slide when the strap is released.

SUMMARY OF THE INVENTION

The present invention provides a compact surgical traction device allowing a single individual to accurately and intuitively tension a patient's limb. The invention provides a track with a traveler having a handle so that tensioning of the strap can be performed directly on the traveler tensioning the limb for intuitive control. The traveler provides a cam mechanism automatically locking the slide when tension is released with low back-travel.

Specifically, in one embodiment, the invention provides a medical traction system having an elongate track adapted to attach to a patient support to extend along an adjustment axis positionable fixed with respect to a patient on a patient support. A traveler provides a traction strap attachment point and a first handle for tensioning a traction strap by pulling the traveler along the elongate track, the traveler further providing an upwardly extending lever and first and second cam surfaces engaging with the elongate track to: (a) allow free sliding of the traveler along the track in an adjustment state with the upwardly extending lever within the first angular range about a horizontal axis perpendicular to an extent of the track; and (b) lock the traveler on the track in a fixation state with the upwardly extending lever at a locking angle about the horizontal axis tipped relative to the first angular range toward the patient support.

It is thus a feature of at least one embodiment of the invention to provide rapid and intuitive tension control by allowing the operator to pull directly on the traveler attached to the traction strap thereby sensing the tension during this adjustment.

The traction strap attachment point may be on the upwardly extending lever whereby tension on the tensioning strap urges the first and second cam surfaces into the fixation state.

It is thus a feature of at least one embodiment of the invention to allow the force of tension to automatically increase the restraining force on the cams, eliminating the need for difficult to overcome biasing of the springs or the like.

The traction strap attachment point may be a hole.

It is thus a feature of at least one embodiment of the invention to provide a simple but positive attachment of the traction strap to the traveler that can resist dislodgment at a variety of angles.

The first handle may be attached to the upwardly extending lever at a first handle attachment point no higher than the traction strap attachment point.

It is thus a feature of at least one embodiment of the invention to provide a handle that relieves the force of engagement on the cam surfaces while providing a slight torque on the handle that keeps the surfaces engaged for low back-travel when the handle is released.

A line between the first handle attachment point and the strap attachment point maybe angled with respect to the adjustment axis by at least 100 and less than 30° upwardly toward the patient to approximate an angle of the traction strap during use.

It is thus a feature of at least one embodiment of the invention to align the handle with the axis of force on the traction strap for improved intuitive tensioning control by the user.

The first handle may be a bar extending from the handle on both sides of the handle in the direction perpendicular to the adjustment axis.

It is thus a feature of at least one embodiment of the invention to provide a T-handle type design that can be simply integrated with the lever while spreading the force of traction evenly over a user's fingers.

The traction system may further include a second handle positioned on the upwardly extending lever at a point no lower than the traction strap attachment point.

It is thus a feature of at least one embodiment of the invention to displace a release handle from the tensioning handle to enlist the force on the traction strap to provide a torque releasing the first and second cam surfaces for rapid release of tension.

The second handle maybe an arcuate extension of the upwardly extending lever concave toward the patient.

It is thus a feature of at least one embodiment of the invention to provide a trigger shape indicating the operation direction of the second lever and a second lever design providing reduced finger purchase that intuitively steers the individual to the first handle for tensioning.

A force on the traction strap attachment point may produce a torque on the upwardly extending lever pressing the first and second cam surfaces against the elongate track with a normal force at least two times the force on the traction strap attachment point.

It is thus a feature of at least one embodiment of the invention to provide appropriate mechanical advantage to convert normal patient traction forces into a fixation force between the track and traveler.

The traveler may provide guide surfaces engaging with the elongate track in the adjustment state to align the traveler with the adjustment axis.

It is thus a feature of at least one embodiment of the invention to prevent binding between the track and traveler with slight off axis forces that may be expected in a surgical traction.

A line between the traction strap attachment point and a pivot point defining rotation of the upwardly extending lever within a vertical plane of the adjustment axis may be within 10° of vertical when the elongate track is horizontal and the upwardly extending lever is in the fixation state.

It is thus a feature of at least one embodiment of the invention to provide the fixation state with the lever in a position of maximum torque from the expected traction force to minimize inadvertent release of the traction device from off axis forces.

The elongate track may provide a tubular channel open at a slot along the extent of the elongate track with the first and second cam surfaces fitting within the channel and the upwardly extending lever passing through the slot, wherein the first and second cam surfaces engage interior surfaces of the elongate track so that the fingers of an average adult operator are blocked from contact with the first and second cam surfaces in the elongate track.

It is thus a feature of at least one embodiment of the invention to provide a design that removes potential pinch points from contact with the user.

The first cam surface may be a shaft extending perpendicularly from the adjustment axis and fitting within opposed corresponding interior grooves of the elongate track to be guided by the interior grooves along an extent of the track independent of contact between the traveler and other portions of the elongate track and wherein the second cam surface is a portion of a second lever extending from the shaft and angled with respect to the first lever.

It is thus a feature of at least one embodiment of the invention to provide a well-defined pivot point that may move along the adjustment axis smoothly without looseness or binding.

These particular objects and advantages may apply to only some embodiments falling within the claims and thus do not define the scope of the invention.

DETAILED DESCRIPTION OF THE PREFERRED EMBODIMENT

Figure 1:
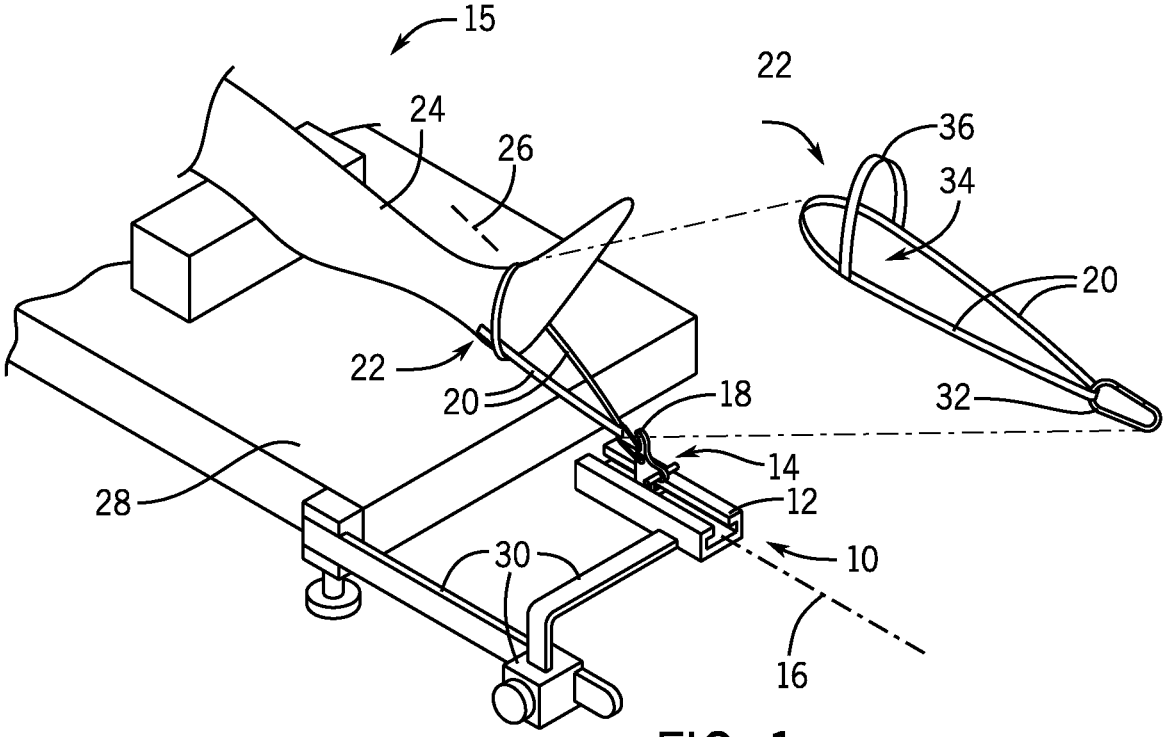
FIG. 1 is a perspective, fragmentary view of a patient table and a traction mechanism fixed with respect to the patient table per the present invention positioned to apply traction on a patient's leg and showing, as an inset, a representative traction strap.

Referring now to FIG. 1, a medical traction system 10 may provide for an elongate track 12 having a traveler 14 movable along the track 12 to follow an adjustment axis 16. The traveler 14 may include a strap attachment point 18 communicating by means of straps 20 with a harness 22 that may attach to an end of a limb 24 of a patient 15.

The elongate track 12 may be fixed with respect to a patient support 28 holding the patient 15, for example, a patient table, by means of an adjustable arm assembly 30 or other similar mechanism so that motion of the traveler 14 can be used to apply a traction force through the straps 20 and harness 22 to the limb 24 along traction axis 26 generally aligned with the straps 20.

Generally the elongate track 12 will be positioned using the adjustable arm assembly 30 or other mounting system, preferably so that the traction axis 26 and adjustment axis 16 lie in the same vertical plane, although generally the traction axis 26 will be angled with respect to the adjustment axis 16 upward toward the patient by an angle from 10° to 30° and some vertical misalignment is expected.

In one embodiment, the straps 20 and harness 22 may be constructed of a polymer webbing such as nylon or the like. The straps 20 may be formed into a loop 34 having a first end toward the traveler 14 connected to the traveler 14 either directly or through a releasable connector 32 such as a spring clip that may be attach releasably to a hole or other feature of the traveler 14. Near the patient 15, the loop 34 may fit around the heel of the patient 15 (in one embodiment) and be retained by an upwardly arching stabilizer strap 36 attached to and passing from one side of the loop 34 on one side of the heel up over the front of the foot and back down to attach to the loop 34 on the other side of the heel. The heel portion of the loop 34 and the strap 36 form the harness 22.

Figure 2:
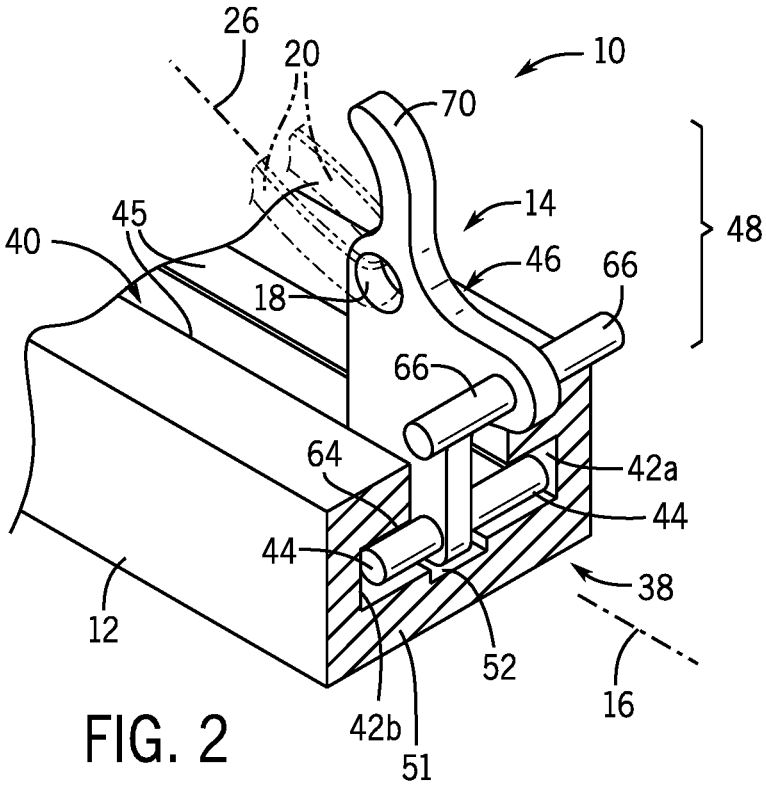
FIG. 2 is a perspective cross-sectional view of the traction mechanism of FIG. 1 showing a traveler that may be slidably positioned along an elongate track, the traveler providing an upwardly extending lever, a tensioning and release handle, and cam surfaces engaging the elongate track in an enclosed channel of the elongate track.

Referring now to FIG. 2, in one embodiment the track 12 may provide a generally C-shaped channel 38 having a generally rectangular cross-section and oriented to present an upwardly open slot 40 extending along the adjustment axis 16. The slot 40 communicates with a central cavity of the channel 38 providing left and right grooves 42*a* and 42*b* opening in opposition toward each other and extending along the length of the track 12 as aligned with the adjustment axis 16. These grooves 42 may receive a transverse cylindrical shaft 44 of the traveler 14 extending perpendicularly to the adjustment axis 16 to slidably move along the adjustment axis 16. The grooves 42 and shaft 44 are sized so that the transverse cylindrical shaft 44 is generally resistant to substantial vertical motion perpendicular to the adjustment axis 16.

The shaft 44 may provide a pivot for an upwardly extending lever 46 of the traveler 14 receiving the shaft 44 transversely therethrough at a lower end within the channel 38 and extending upwardly through the slot 40 to present an exposed portion 48 that may be grasped by a user. The lever 46 may be constructed of a plate having a width substantially equal to a width of the slot 40, a length along the adjustment axis 16, and a height of 2 to 5 inches in one embodiment. A front edge the lever 46 provides the strap attachment point 18, for example, in the form of a transverse hole through a plate forming the lever 46.

Figure 3:
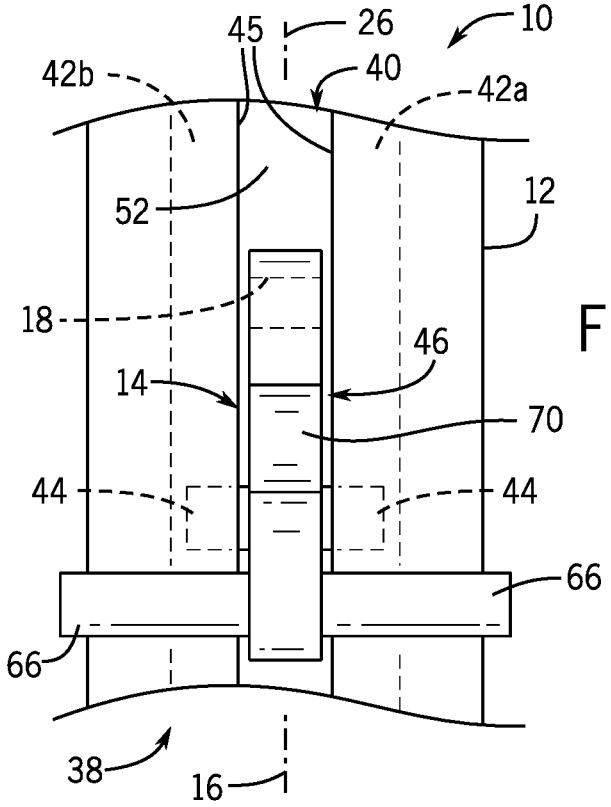
FIG. 3 is a fragmentary top plan view of the channel 38 of FIG. 2 showing the protection of the cam surfaces within the channel of the elongate track and the alignment provided by a channel 38 slot and left and right walls of the upwardly extending lever.

Referring also to FIG. 3, as noted, the width of the slot 40 is such as to present opposed slot walls 45 which slidingly abut left and right surfaces of the lever 46 to guide the lever 46 along the adjustment axis 16 without substantial twisting about its vertical axis as shown. This rotational constraint also preserves transverse orientation of the shaft 44 preventing a binding or jamming of the shaft 44 within the grooves 42. It will be appreciated that the lever 46 as attached to the shaft 44 is also prevented from vertical lifting out of the slot 40 or downward vertical motion by the upper surfaces and lower surfaces of the grooves 42 which closely slidingly abut corresponding surfaces of the shaft 44. As supported by the shaft 44, the lever 46 rotates about a horizontal axis of the shaft 44 within a vertical plane aligned with the alignment axis.

Figure 4:
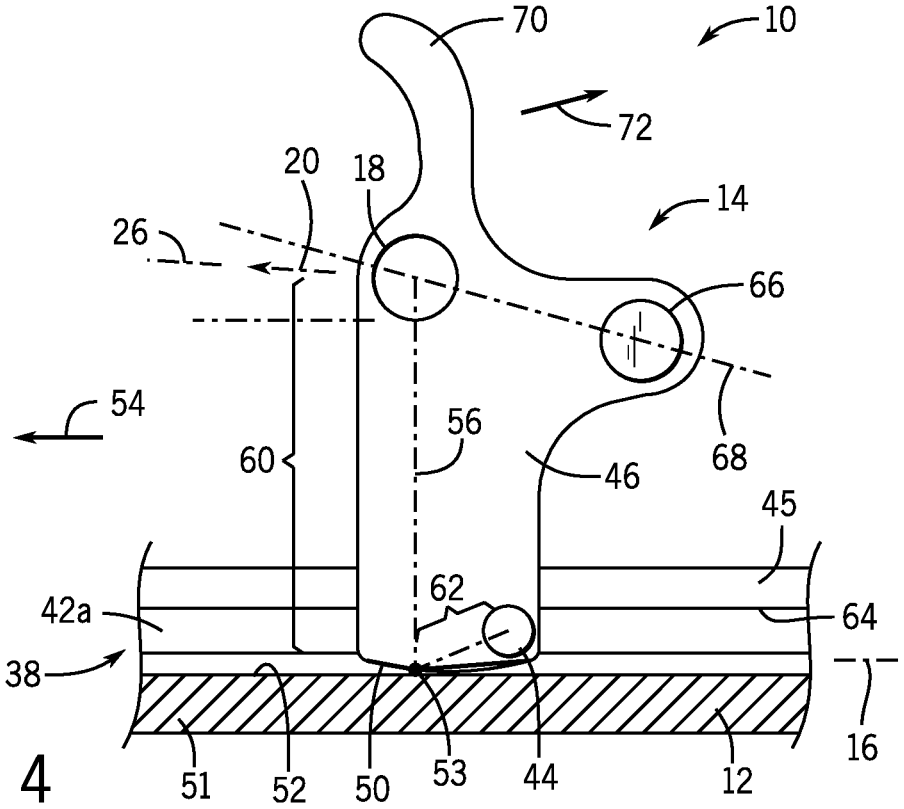
FIG. 4 is an elevational cross section taken along a midline of the track of FIGS. 1 and 2 showing the internal cam surfaces within the elongate track and the relationship to the traction strap attachment point and the first and second handles for tensioning and releasing tension on the traction strap.

Referring also to FIG. 4, a lower edge 50 of the plate forming the lever 46 within the channel 38 of the track 12 may contact an upper surface 52 of a bottom wall 51 of the channel 38 at a contact point 53 when the lever 46 rotates in a forward direction 54 toward the patient 15. This position of contact will define a fixation state of the lever 46 defined by its angle. When the lever 46 is in the fixation state, a lever axis 56 of the lever 46 (extending from the strap attachment point 18 to the contact point 53) will approach vertical and ideally within 30° of vertical with respect to a horizontal plane aligned with the adjustment axis 16. This orientation roughly perpendicular to the traction axis 26 increases the torque on the lever 46 about the shaft 44 caused by force on the traction axis 26 and maximizes a range of angles of the traction axis 26 providing such high torque.

More specifically, force applied along the traction axis 26 will operate on a first lever length 60 between the strap attachment point 18 and the shaft 44 to rotate the lever 46 in a counterclockwise direction as depicted in FIG. 4 increasing the contact force between the lever 46 and the track 12 at contact point 53 to prevent sliding motion of the traveler 14 toward the patient 15. Generally, the force of such contact and hence the ability of the traveler 14 to resist movement will be a function of the force on the traction axis thus preventing slippage at a range of forces of traction. More specifically, the force of contact at contact point 53 will be greater than the force of traction by a ratio of the lever length 60 and a lever length 62 defined between the shaft 44 and the contact point 53, thus providing a mechanical advantage of two or preferably at least three times ensuring that the force between the lever 46 and track 12 and contact point 53 is sufficient to prevent sliding of the traveler 14 with respect to the track 12.

Referring still to FIG. 4, it will be appreciated that this locking of the traveler 14 on the track 12 is caused in this embodiment by two opposed cam surfaces, the first cam surface formed by contact between an upper portion of the shafts 44 and downwardly facing surface of upper walls 64 of the groove 42 and the second cam surface being between the lower edge 50 of the lever 46 and the upper surface 52 of the bottom wall 51 of the channel 38 of the track 12 at contact point 53. Referring to FIG. 3, these cam surfaces of the contact points shaft 44 and lower edge 50 will be safely protected within the channel 38 to shield healthcare professionals from potential pinch points and to shield the surfaces from contamination, for example, from liquids which might reduce the desired camming friction.

Referring now to FIGS. 2 and 4, in one embodiment, a T-bar handle 66 may be attached at a rear edge of the lever 46. The T-bar handle 66 may provide a shaft extending transversely through the lever 46 to extend on either side of the lever 46 by an amount allowing a gripping of the T-bar handle 66 by the fingers of a healthcare professional. The T-bar handle is sized to allow the healthcare professional to provide substantial force to the T handle 66 commensurate with the desired amount of traction while rotating the lever 46 away from the fixation state to a release state allowing the traveler 14 to be drawn backward along the track 12 to increase the tension on the straps 20 along the traction axis 26. In one embodiment, as depicted in FIG. 4, the handle 66 may be along a line of action 68 extending between the handle 66 and the strap attachment point 18 within a vertical plane of the adjustment axis, this line of action 68 desirably aligned with the traction axis 26 in anticipated use situations. In this way, the handle 66 is located so that a pulling on the handle 66 causes the user to experience fully the tension along the traction axis 26 for a quick intuitive traction adjustment.

Figure 5:
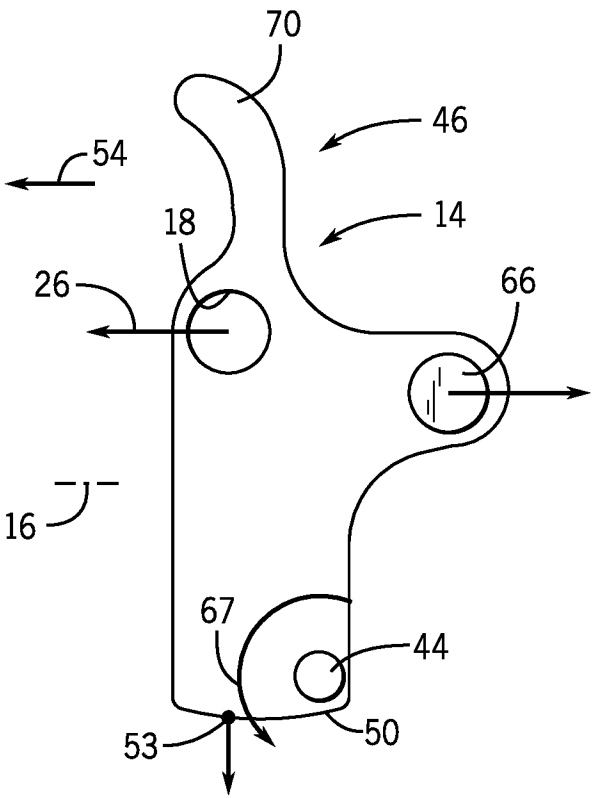
FIG. 5 is a simplified representation of the lever of FIG. 4 during a tensioning process showing forces that tend to provide close abutment of the cam surfaces for rapid engagement when the tensioning handle is released.

Referring now also to FIG. 5, the position of the handle 66 on the lever 46 may be desirably at or below the height of the strap attachment point 18 measured with respect to the contact point 53 and desirably below so that pulling on the handle 66 together with the tension of the straps 20 on the lever 46 provide a very slight counterclockwise rotational torque 67 to the lever 46 about the shaft 44 keeping the lower edge 50 of the lever 46 in close contact with the upper surface 52 of the channel 38 while reducing contact pressure at contact point 53 enough to allow sliding of the lever 46 within the channel 38 rearward to increase traction force. This close contact during adjustment, and in particular when increasing the traction force, ensures that when the handle 66 is released there is little counterclockwise rotation of the lever 46 that might decrease the traction force by loosening the straps 20 with rotation of the lever 46 forward toward the patient 15.

Figure 6:
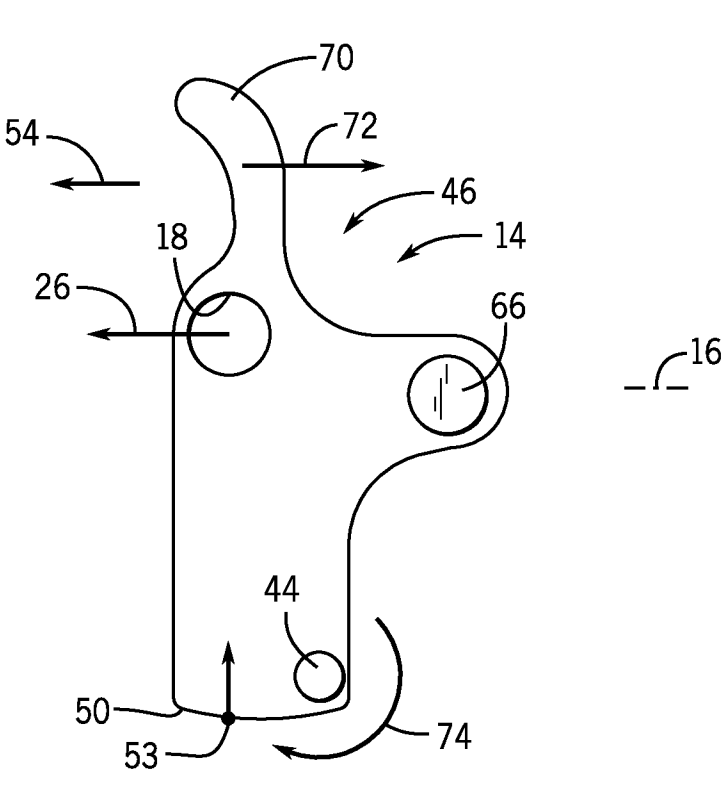
FIG. 6 is a figure similar to that of FIG. 5 during the release process showing reverse torsion provided by force on the release handle causing the tension strap to promote rapid release of the traveler.

Referring now to FIGS. 4 and 6, during use, the traveler 14 is pulled away from the patient to tension the straps 20 by a healthcare professional pulling the handle 66 away from the patient 15. When the handle 66 is released, tension on the straps 20 pulls the lever 46 so that the cam surfaces of the shaft 44 and the lower edge 50 engage the track 12 to prevent forward motion. There is very little back travel because of the torsion described above which keeps the cam surfaces close together during the adjustment process.

When it is time to release the tension on the straps 20, the lever 46 may be pulled backwards away from the patient 15 using a second handle 70. The second handle 70, in one example, may be an upward extension of the lever 46 above the strap attachment point 18. In one embodiment, the handle 70 is given a forwardly concave surface suggesting a trigger and thus the proper direction of activation for release of the traveler 14. Pulling backward on the handle 66 along release axis 72 disengages the cam surfaces allowing the traveler 14 to move forward toward the patient under the force of the tension on the straps 20.

As best seen in FIG. 6, by placing the handle 70 above the strap attachment point 18, force on the second handle 70 along the release axis 72 together with the force along the traction axis 26 from the straps 20 creates a slight clockwise torsion 74 around the shaft 44 that lifts the lower edge 50 from the contact point 53. The force along traction axis 26 then quickly pulls the traveler 14 toward the patient 15 quickly releasing tension in a set of cascading motions.

As discussed above, it will be appreciated that the locking of the lever 46 in the track is caused by two camming surfaces of the upper surface of the shaft 44 pressing against the upper walls 64 of the groove 42 and the lower edge 50 pressing downward at point of 53 on the upper surface 52 of a bottom wall of the channel 38. Generally, the frictional forces imposed by these two camming surfaces need not be equal (in fact one could be a bearing) provided one such frictional force of contact is sufficient to restrain the lever 46 against longitudinal motion. In this regard the cams of the invention should be regarded as points of pressure that operate together to create frictional forces even though the frictional forces may be dominant on one of the surfaces.

Figure 8:
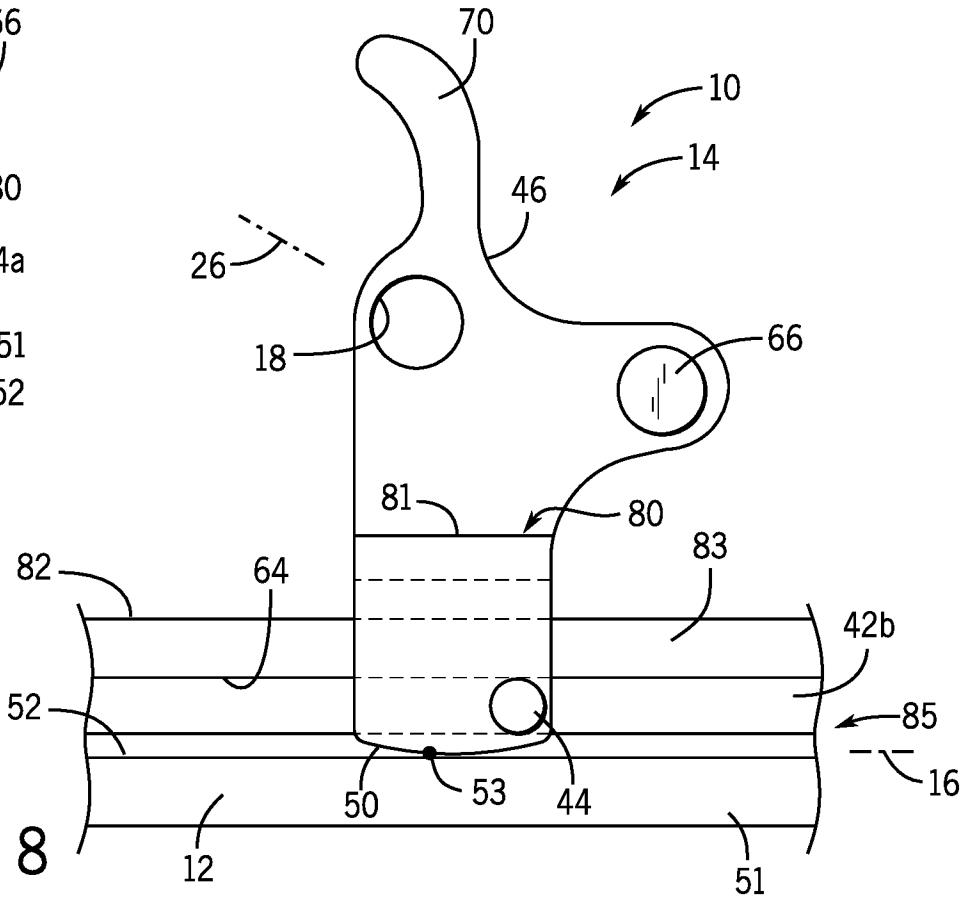
FIG. 8 is a figure similar to that of FIG. 4 for the embodiment of FIG. 7.
Figure 7:
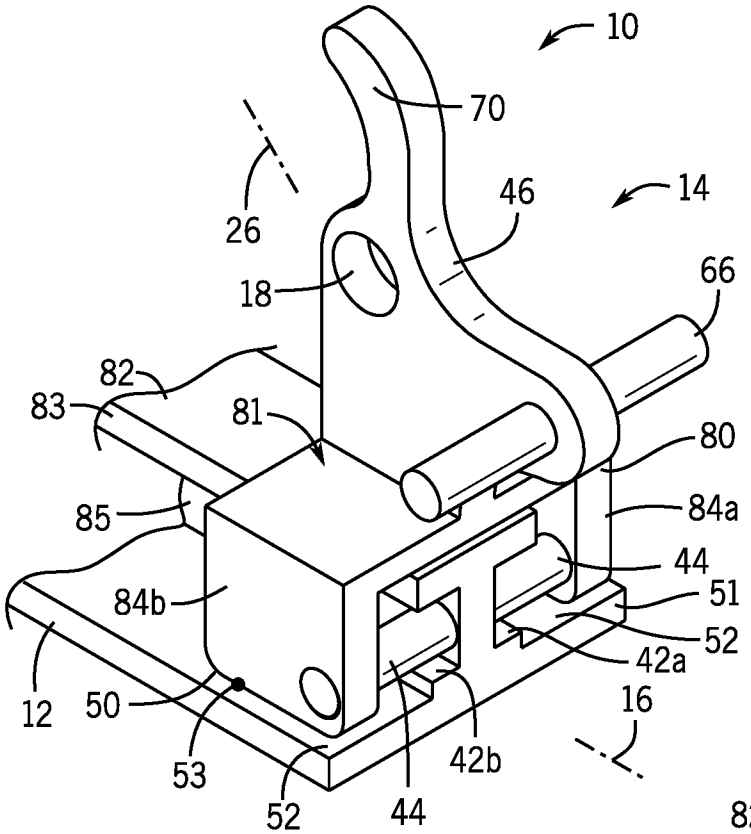
FIG. 7 is a figure similar to that of FIG. 2 showing an alternative embodiment to the traction mechanism of FIG. 2 in which the cam surfaces are within an enclosure provided by the traveler rather than the track.
Figure 10:
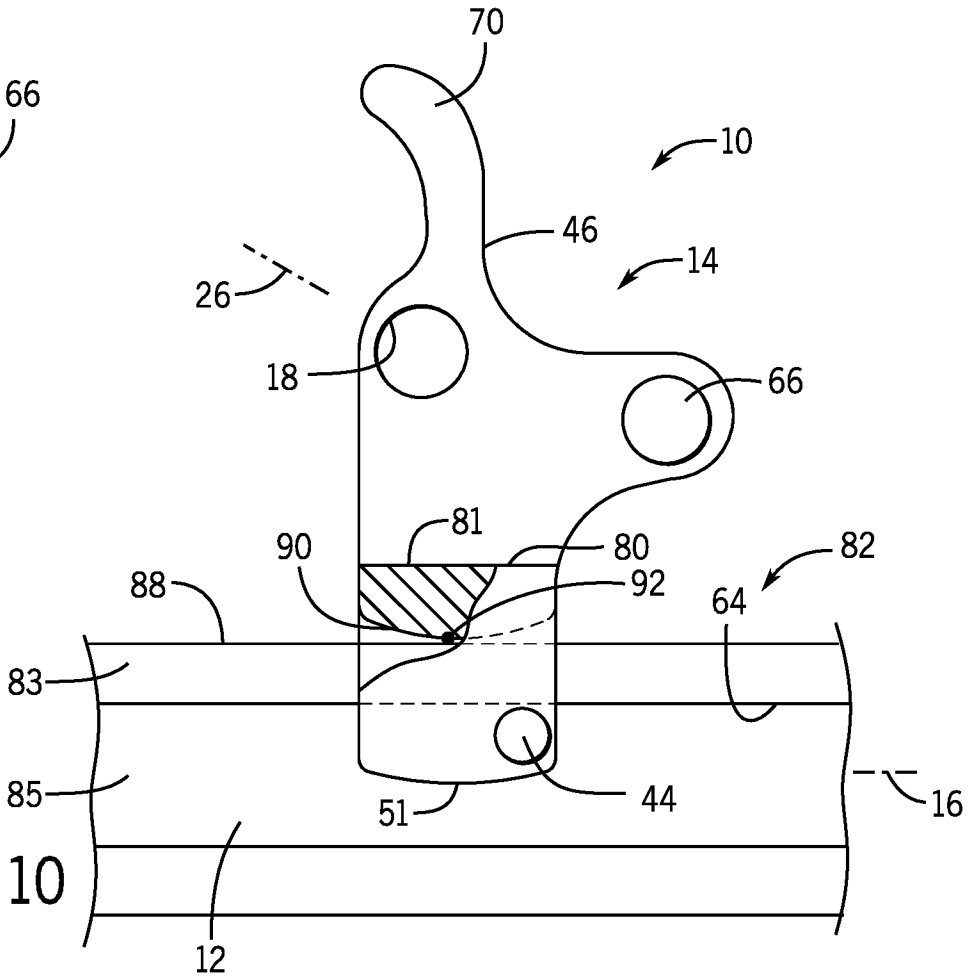
FIG. 10 is a figure similar to that of FIG. 8 for the embodiment of FIG. 9.

Referring now to FIGS. 7 and 8, the principles of the present invention can be implemented with changes in the relationship between the track 12 and the traveler 14, and in particular by changing the enclosing track 12 surrounding the camming surfaces described above into an enclosing traveler 14 surrounding the track. In one such embodiment, the elongate track 12 may be in the form of a T-bar 82 having a horizontal bar portion 83 spaced by a central vertically downwardly extending stem portion 85 above the horizontal bottom wall 51. In this embodiment, the lever 46 may extend downward in a saddle block 80 having a horizontal portion 81 extending left and right from the connection to the upper portion of the lever 46. This horizontal portion 81 at its left and right edges connects with the upper edges of vertical walls 84*a* and 84*b* which extend downward to flank the T-bar 82. The T-bar 82, in the space between the bar 83 and the bottom wall 51, provides grooves 42*a* and 42*b* which now open in opposite directions from the stem portion 85 and are formed between a lower surface of the bar of the T-bar 82 and the bottom wall 51. Again, these grooves 42 receive corresponding shafts 44 passing inwardly, respectively, from outer vertical walls 84*a* and 84*b* of the saddle block 80.

In this embodiment, each of the outer vertical walls 84 provides a lower edge 50 as described above providing a contact point 53 between the lower edge 50 and the upper surface 52 of the bottom wall 51. These contact points provide a first of two opposed cam surfaces that work with a second cam surface at the contacts between the shafts 44 and the lower surfaces of the bar of the T-bar 82.

Figure 9:
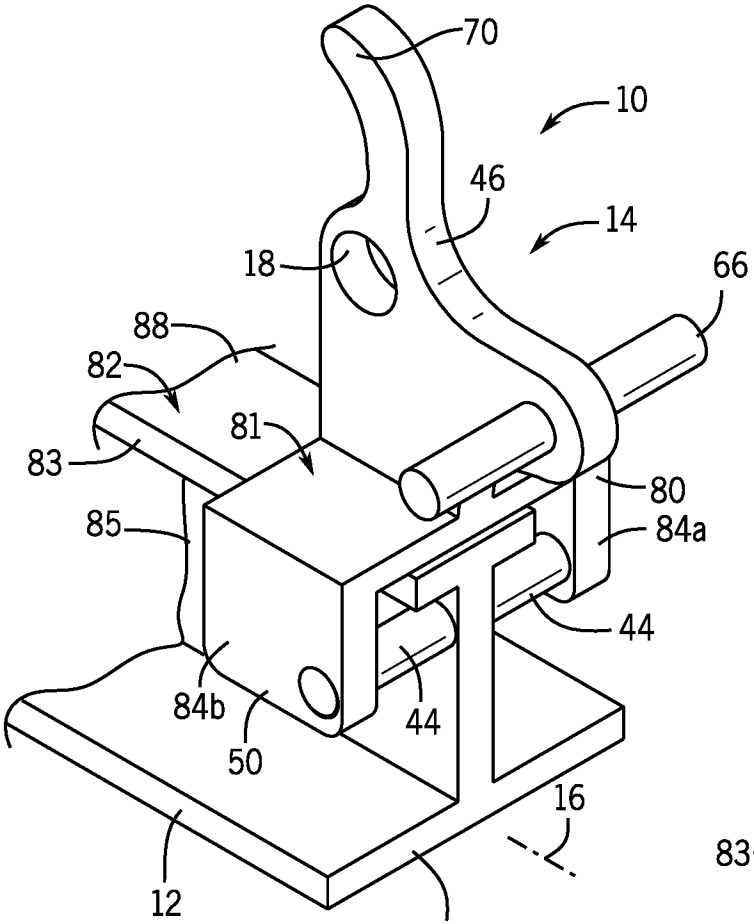
FIG. 9 is a figure similar to FIG. 7 showing a displacement of one of the cam surfaces to an upper portion of the track.

Referring now to FIG. 9, this design may be modified slightly, for example, using a T-bar 82 whose stem portion 85 is sufficiently tall as to prevent contact between the lower edge 50 of the vertical walls 84 and the upper surface 52 of the bottom wall 51. In this case, the second camming surface is provided between the upper surface 88 of the horizontal bar portion 83 of the T-bar 82 and a bottom surface 90 of the horizontal portion 81 of the saddle block 80. Contact between these services provides in the fixation state a contact point 92 analogous to contact point 53. The operating principles of these devices of FIGS. 7, 8, 9, and 10 may otherwise follow those described in the embodiments related to FIG. 2.

Generally, the structures of the track 12 and the traveler 14 may be constructed of a sturdy metallic material such as aircraft aluminum or stainless steel to be easily sterilized and cleaned. It will be appreciated in this regard that the track 12 may be open at one or both ends to allow easy disassembly of the track 12 and traveler 14 also for cleaning.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A low back-travel medical traction system comprising:

an elongate track adapted to attach to a patient support to extend along an adjustment axis positionably fixed with respect to a patient on a patient support; and a traveler inter-fitting with the elongate track to slide along the adjustment axis and having a traction strap attachment point and a first handle for tensioning a traction strap by pulling the traveler along the elongate track, the traveler providing an upwardly extending lever and first and second cam surfaces engaging with the elongate track to:

(a) allow free sliding of the traveler along the elongate track in an adjustment state with the upwardly extending lever within a first angular range about a horizontal axis perpendicular to an extent of the elongate track;

(b) lock the traveler on the elongate track in a fixation state with the upwardly extending lever at a locking angle about the horizontal axis tipped relative to the first angular range toward the patient support;

wherein the traction strap attachment point is on the upwardly extending lever whereby tension on the traction strap urges the first and second cam surfaces into the fixation state; and wherein the first handle attaches to the upwardly extending lever at a first handle attachment point no higher than the traction strap attachment point.

2. The low back-travel medical traction system of claim 1 wherein the traction strap attachment point is a hole.

3. The low back-travel medical traction system of claim 1 wherein a line between the first handle attachment point and the traction strap attachment point is angled with respect to the adjustment axis by at least 10° and less than 30° upwardly toward the patient to approximate an angle of the traction strap during use.

4. The low back-travel medical traction system of claim 1 wherein the first handle is a bar extending from the first handle attachment point on both sides of the upwardly extending lever in a direction perpendicular to the adjustment axis.

5. The low back-travel medical traction system of claim 1 further including a second handle positioned on the upwardly extending lever at a point no lower than the traction strap attachment point.

6. The low back-travel medical traction system of claim 5 wherein the second handle is an arcuate extension of the upwardly extending lever concave toward the patient.

7. The low back-travel medical traction system of claim 1 wherein a force on the traction strap attachment point produces a torque on the upwardly extending lever pressing the first and second cam surfaces against the elongate track with a normal force at least two times the force on the traction strap attachment point.

8. The low back-travel medical traction system of claim 1 wherein the traveler provides guide surfaces engaging with the elongate track in the adjustment state to align the traveler with the adjustment axis.

9. The low back-travel medical traction system of claim 1 wherein a line between the traction strap attachment point and a pivot point defining rotation of the upwardly extending lever within a vertical plane of the adjustment axis is within 10° of vertical when the elongate track is horizontal and the upwardly extending lever is in the fixation state.

10. The low back-travel medical traction system of claim 1 wherein the elongate track provides a tubular channel open at a slot along the extent of the elongate track with the first and second cam surfaces fitting within the tubular channel and the upwardly extending lever passing through the slot; and wherein the first and second cam surfaces engage interior surfaces of the tubular channel so that fingers of an average adult operator are blocked from contact with the first and second cam surfaces in the tubular channel.

11. A low back-travel medical traction system comprising:

an elongate track adapted to attach to a patient support to extend along an adjustment axis positionably fixed with respect to a patient on a patient support; and a traveler inter-fitting with the elongate track to slide along the adjustment axis and having a traction strap attachment point and a first handle for tensioning a traction strap by pulling the traveler along the elongate track, the traveler providing an upwardly extending lever and first and second cam surfaces engaging with the elongate track to:

(a) allow free sliding of the traveler along the elongate track in an adjustment state with the upwardly extending lever within a first angular range about a horizontal axis perpendicular to an extent of the elongate track;

(b) lock the traveler on the elongate track in a fixation state with the upwardly extending lever at a locking angle about the horizontal axis tipped relative to the first angular range toward the patient support; and wherein the first cam surface is a shaft pair extending perpendicularly to the adjustment axis and fitting within opposed corresponding interior grooves of the elongate track to be guided by the interior grooves along an extent of the elongate track independent of contact between the traveler and other portions of the elongate track and wherein the second cam surface is a portion of the upwardly extending lever, displaced from the shaft pair.

12. The low back-travel medical traction system of claim 11 wherein a distance between the shaft pair and the traction strap attachment point is at least twice a distance between the shaft pair and a contact point between the upwardly extending lever and the elongate track in the fixation state.

13. The low back-travel medical traction system of claim 1 further including a traction strap attached to the traction strap attachment point and providing a loop fitting around a patient's heel and further including a stabilizer strap attaching to opposite sides of the loop at the heel of a supine patient and passing over a top of the patient's foot to retain the loop on the heel against downward force.

14. The low back-travel medical traction system of claim 1 further including a patient support for supporting a supine patient attached to the elongate track so that the adjustment axis is parallel to an upper surface of the patient support.

15. The low back-travel medical traction system of claim 1 wherein the first and second cam surfaces have fixed separation.

* * * * *